US006280277B1

(12) United States Patent
Greenberg et al.

(10) Patent No.: US 6,280,277 B1
(45) Date of Patent: Aug. 28, 2001

(54) COMBINATION WATER GUN AND SELF-PROPELLED WATER TOY

(75) Inventors: Michael A. Greenberg, Mendham Township; Richard J. Greenberg, Warren, both of NJ (US)

(73) Assignee: Shelcore, Inc., Somerset, NJ (US)

( * ) Notice: Subject to any disclaimer, the term of this patent is extended or adjusted under 35 U.S.C. 154(b) by 0 days.

(21) Appl. No.: 09/604,076

(22) Filed: Jun. 27, 2000

(51) Int. Cl.[7] ..... A63H 23/06; A63H 33/18

(52) U.S. Cl. ..... 445/161; 446/211; 446/473; 222/79

(58) Field of Search ..... 446/153, 160, 446/161, 162, 163, 176, 211, 473; 222/79

(56) References Cited

U.S. PATENT DOCUMENTS

| | | | | |
|---|---|---|---|---|
| D. 348,913 | | 7/1994 | Rudell . | |
| 2,410,682 | * | 11/1946 | Richardson | 446/211 X |
| 2,826,001 | * | 3/1958 | Presnell | 446/161 |
| 3,695,607 | * | 10/1972 | Stouffer | 446/161 X |
| 4,179,841 | * | 12/1979 | Kupperman et al. | 446/162 |
| 4,239,129 | | 12/1980 | Esposito | 222/79 |
| 5,074,437 | | 12/1991 | D'Andrade et al. | 222/79 |
| 5,150,819 | | 9/1992 | Johnson et al. | 222/79 |
| 5,244,431 | * | 9/1993 | D'Andrade | 446/473 X |
| 5,305,919 | | 4/1994 | Johnson et al. | 222/79 |
| 5,339,987 | | 8/1994 | D'Andrade | 222/79 |
| 5,419,458 | | 5/1995 | Mayer | 222/79 |
| 5,474,486 | | 12/1995 | Chilton et al. | 446/456 |
| 5,564,961 | | 10/1996 | Spector | 446/72 |
| 5,667,419 | | 9/1997 | Spector | 446/72 |

FOREIGN PATENT DOCUMENTS

| | | | | |
|---|---|---|---|---|
| 4327009 | * | 2/1995 | (DE) | 446/161 |

* cited by examiner

*Primary Examiner*—John A. Ricci
(74) *Attorney, Agent, or Firm*—Bacon & Thomas

(57) ABSTRACT

A toy includes a main body which, in a first orientation, resembles a water gun and, in a second orientation, resembles a vehicle. Within the main body is an air/water reservoir which may be filled with water, the reservoir being in communication with a source of air pressured by a hand-pump to cause water to be forcibly expelled from the reservoir upon opening a valve at a water outlet of the reservoir. The water outlet is controlled by a trigger mechanism which, when the toy is in the first orientation, resembles the trigger of a gun and permits opening and closing ofthe valve to occur upon pulling and release of the trigger. In the second orientation, the trigger mechanism is latched upon pulling the trigger in order to permit continued expulsion of water upon release of the trigger so that the expulsion of water serves to propel the vehicle. The vehicle may be a water craft such as a submarine and include realistic appurtenances or accessories that may be manipulated to provide a more realistic appearance. In the case of a submarine, the appurtenances may include stabilizer fins pivotal into a horizontal orientation, and louvers that cause the vehicle to dive below the surface, the portion of the housing accommodating the trigger being arranged to resemble a conning tower of the submarine, and the air/water reservoir being positioned to cause the submarine to dive when full and to return to the surface as the reservoir empties. In addition, the toy may be provided with a circuit and speaker for providing sound effects in one or both orientations.

25 Claims, 8 Drawing Sheets

1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
59
60
61
80
81
82
87
88
92
95
100
101
106
136

COMBINATION WATER GUN AND SELF-PROPELLED WATER TOY

BACKGROUND OF THE INVENTION

1. Field of the Invention

The present invention generally relates to a toy, and more particularly to a water gun that converts to a self-propelled water toy.

The invention doubles the enjoyment provided by a water gun by enabling the water gun to be converted into a realistic self-propelled toy water craft, such as a toy submarine. The water gun is preferably a pump-action water gun of the type in which air is pumped into a reservoir in order to apply pressure to water in the reservoir, causing the water to be expelled forcefully upon opening of an outlet valve in response to activation of a trigger. When the toy is converted into a water craft, a trigger latch holds open the outlet valve so that water is expelled continuously even after the trigger is released.

2. Description of the Related Art

The combination water gun and submarine toy of the present invention modifies the known type of pump-action, air pressure type of water gun so that it can be converted into a toy water craft, and in particular into a toy submarine.

Pump-action water guns that utilize air pressure to forcefully expel a continuous stream of water have recently attained widespread popularity. In the conventional pump-action water gun of this type, air is pumped into the water reservoir to apply pressure to water in the reservoir. When a trigger is operated to open an outlet valve for the reservoir, the water is expelled in a continuous stream at a force that is greater than can be provided by a conventional purely mechanical pump system, thus providing wetter and more fun water play. Examples of pump-action, air pressure type water guns are disclosed in U.S. Pat. No. 4,239,129 (which also discloses a combined water gun/flashlight), U.S. Pat. Nos. 5,074,437, 5,150,819, 5,305,919, 5,339,987, and 5,419,458.

Like the water gun of the present invention, most conventional water guns, whether of the air pressure or purely mechanical type, are constructed to resemble actual or stylized firearms. However, unlike the water gun of the present invention, when the conventional water gun is turned over or tossed into a body of water, it does not even remotely resemble or suggest any sort of vehicle or water craft, much less a self-propelled water craft that utilizes the water expelling mechanism of the water gun as a means of propulsion for the water craft. As a result, when play with the water guns is over, or when it is too cold outdoors for water play, the water guns must be set aside.

To increase the versatility of conventional water guns, it has previously been proposed to combine the conventional water guns with other types of toys. For example, U.S. Pat. Nos. 5.564,961 and 5,667,419 disclose water guns hidden in puppets, while U.S. Design Patent No. Des. 348,913 depicts a combination water pistol and airplane. However, the toys with which the water guns described in these patents are combined are not intended as separate playthings, but rather are ornamentally disguised water guns which can essentially only be used for water gun play.

It has also been proposed in U.S. Pat. No. 5,474,486 to add a water squirting mechanism to a remote-controlled self-propelled vehicle in order to increase the versatility and attractiveness ofthe vehicle. However, in order to achieve such versatility, the combined vehicle utilizes a relatively complex and expensive arrangement of a separate motor for propelling the vehicle and an electric pump for squirting water. While adding interest to its role as a remote controlled vehicle, the combined vehicle/water squirting toy of this prior patent has a configuration that does not resemble a gun, and is unsuitable for traditional water gun play. In addition, it is not suitable for use as a water craft.

To date, therefore, water guns have been limited to traditional water gun play, while other vehicles, including vehicles intended for swimming pool or bathtub play, have been considered to be entirely separate items unsuitable for traditional water gun play. The possibility of combining a water gun with a self-propelled water craft does not appear to have been even remotely considered, much less the possibility of utilizing the water gun shooting mechanism as the means of propulsion for the vehicle, so that the combined vehicle is no more complicated or expensive than an ordinary air pressure type water gun.

SUMMARY OF THE INVENTION

It is a accordingly a first objective of the invention to provide a water gun with additional functionality, so that the water gun can be played with even when traditional water gun play, i.e., shooting streams of water at others while mimicking the action of a gun, is not permitted or not possible.

It is a second objective of the invention to provide a water gun with additional functionality, in which the additional functionality is that the water gun may be used as a toy water craft.

It is a third objective of the invention to provide a water gun with additional functionality, in which the additional functionality is that the water gun may be used as a self-propelled toy water craft.

It is a fourth objective of the invention to provide a water gun which converts into a toy water craft.

It is a fifth objective of the invention to provide a water gun which converts into a self-propelled toy water craft, and yet which does not require additional motors or other propulsion mechanisms.

It is a sixth objective of the invention to provide a water toy which, when held in a first orientation, resembles and functions as a water gun, and which when turned over, resembles and functions as a toy water craft.

It is a seventh objective of the invention to provide a water toy which, which converts to a self-propelled toy water craft, and in which the self-propelled toy water craft is a realistic toy submarine.

It is a eighth objective of the invention to provide a combination of a pump action/air pressure type water gun with a realistic self-propelled submarine, including optional gun or submarine sound effects.

These objectives are achieved, in accordance with the principles of a preferred embodiment of the invention, by providing a water toy which, in a first orientation or "mode", may be used as a water gun and which, in a second orientation or "mode", may be used as a self-propelled toy water craft. The orientation or mode may be changed by by folding or unfolding parts of the toy although, in the preferred embodiment of the invention, the principal way in which the mode is changed is simply to invert the toy.

In an especially preferred embodiment of the invention, the shape of the toy is such that, in the first orientation or mode, the toy resembles a firearm and, in the second orientation or mode, the toy resembles a submarine or similar water craft, with the portion of the housing accommodating the trigger being arranged to resemble a conning tower of a submarine or other ship. However, the representations may be either realistic, with suitable appurtenances such as fins or louvers to enhance the realism, or highly stylized, and it is within the scope of the invention to construct the toy to have shapes other than those of a firearm and/or submarine, so long as the functionality ofthe "water gun" and "submarine" modes is maintained.

The mechanism by which the two modes are achieved, i. e., which allows the toy to function as a water gun in the first orientation and as a self-propelled water craft in the second orientation, is the same used in a conventional pump-action, air pressure type water gun, with the modification that in the second orientation the trigger will latch to provide continuous expulsion of water from a nozzle for use in propelling the toy.

More particularly, within the main body of a toy having the above-described characteristics is an air/water reservoir arranged to be filled with water. The reservoir is in communication with a hand-pump which pressurizes the air/water reservoir to cause water to be forcibly expelled from the reservoir upon opening a valve at a water outlet of the reservoir. The water outlet valve is controlled by a trigger mechanism which, when the toy is in the first orientation, respectively opens and closes the valve upon pulling and release of the trigger. In the second orientation, however, the trigger mechanism is latched upon pulling the trigger in order to permit continued expulsion of water upon release of the trigger so that the expulsion of water serves to propel the vehicle.

While the invention is not to be limited to a particular type of latch, in the illustrated embodiment ofthe invention, the latch is a slidable member arranged to extend into a notch in an extension of the trigger when the toy in the second orientation and the trigger is pulled to align the notch with the slidable member and open the reservoir outlet valve. When the toy is in the first orientation, the latch is moved to a position away from the trigger extension so that the trigger can be operated in conventional fashion.

The manner in which the reservoir empties when the toy is in the second orientation or submarine mode can be utilized to cause the toy to initially dive due to the weight of the water in the reservoir, and to return to the surface as the reservoir empties for an especially realistic submarine effect, although those skilled in the art will appreciate that the buoyancy of the toy can also be arranged to prevent diving, causing the toy to move across the surface of the water only. In addition, a ballast arrangement can be provided to permit the toy to selectively exhibit either a surface cruising or a diving effect.

In the embodiment of the invention in which the toy is constructed to resemble a firearm when in the first orientation or mode and a submarine when in the second orientation or mode, the toy may include a number of realistic appurtenances or accessories arranged to be manipulated to provide a more realistic appearance in either or both orientations or modes. The appurtenances or accessories may include stabilizer fins pivotal into a horizontal or angled orientation when in the submarine mode to cause the submarine to dive, and a pivotal rudder that permits the direction of the submarine to be predetermined. In addition or alternatively, the toy may include louvers that may be pivoted out in the water gun mode to enhance the appearance of a firearm., the portion of the housing accommodating the trigger being arranged to resemble a conning tower of the submarine.

In addition to mechanical appurtenances or accessories, the toy of the preferred embodiment of the invention may be provided with a battery or generator powered circuit and speaker for providing sound effects appropriate to one or both of the respective modes, and a sound effect actuator button assembly having the appearance of an accessory such as a tail fin or automatic weapon grip. In addition, those skilled in the art will appreciate that elements such as LEDs or other lighting devices may also be provided to further enhance the appearance of the toy, and that further modifications may also be made without departing from the scope of the invention, such as the use of air pressure created by the pump to power still further accessories.

DETAILED DESCRIPTION OF THE PREFERRED EMBODIMENTS

Figure 1:
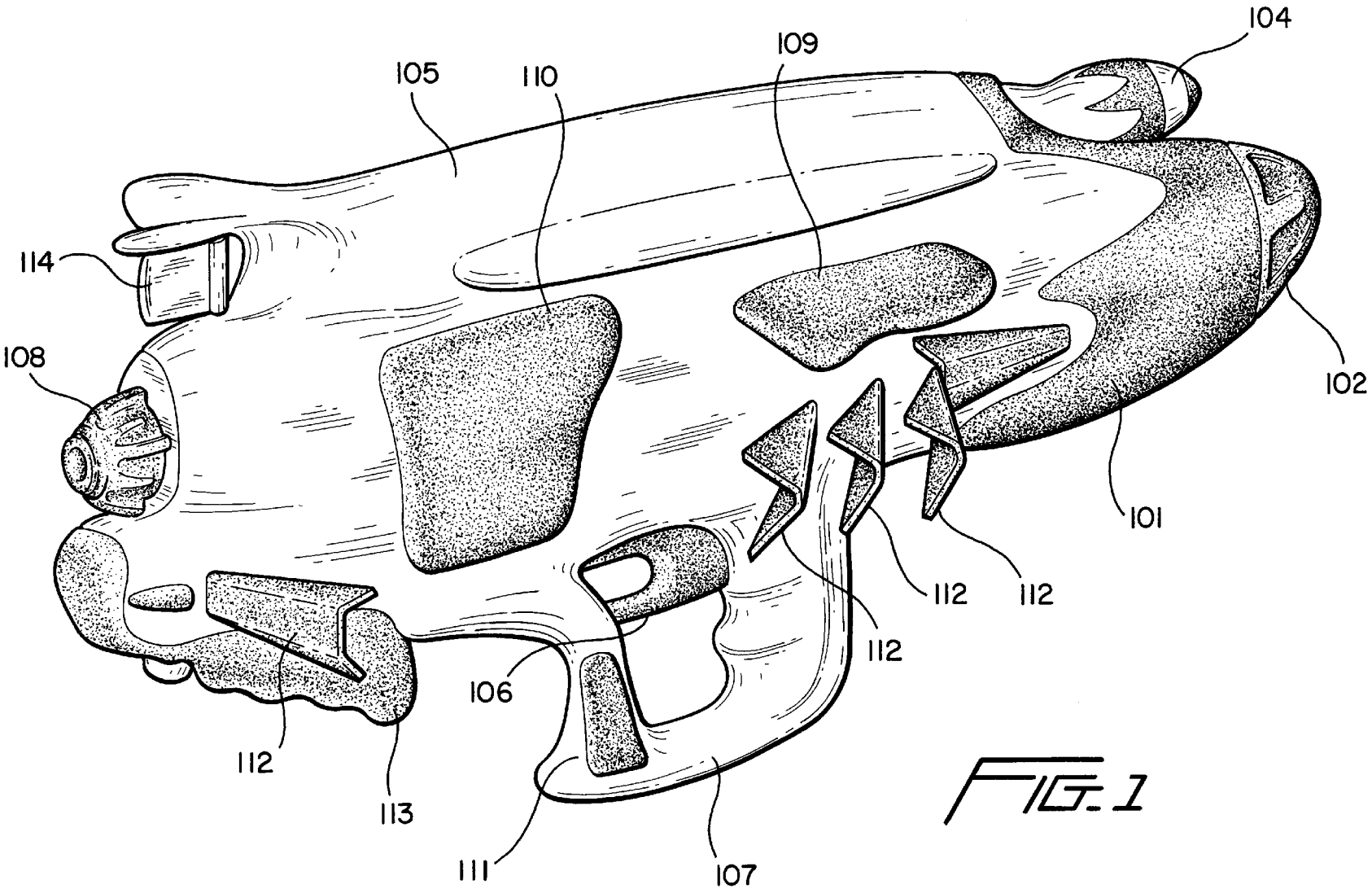
FIG. 1 is a perspective view of a water toy constructed in accordance with the principles of the invention, shown in its water gun mode.
Figure 2:
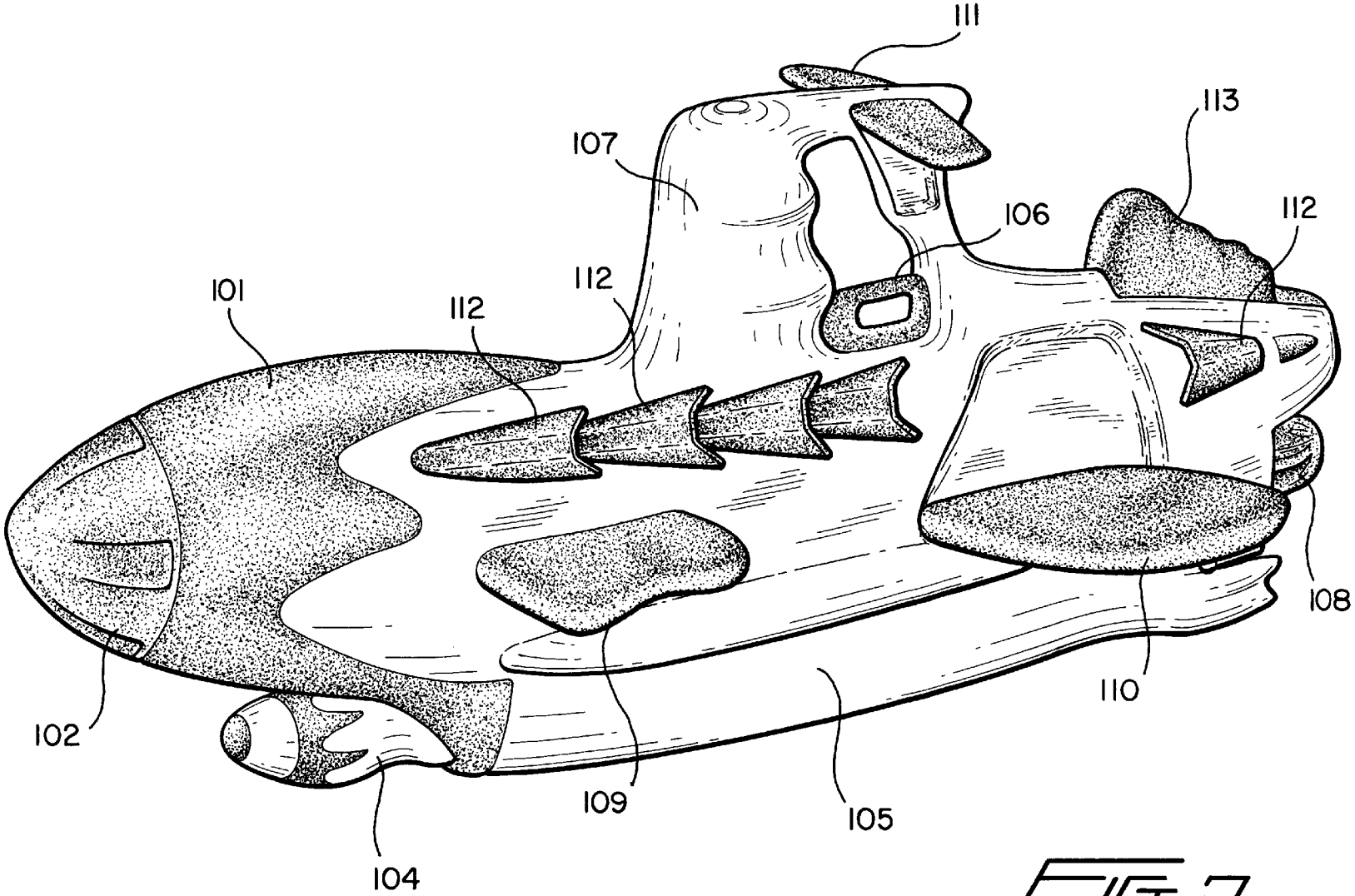
FIG. 2 is a perspective view of the water toy of FIG. 1, shown in its submarine mode.
Figure 3:
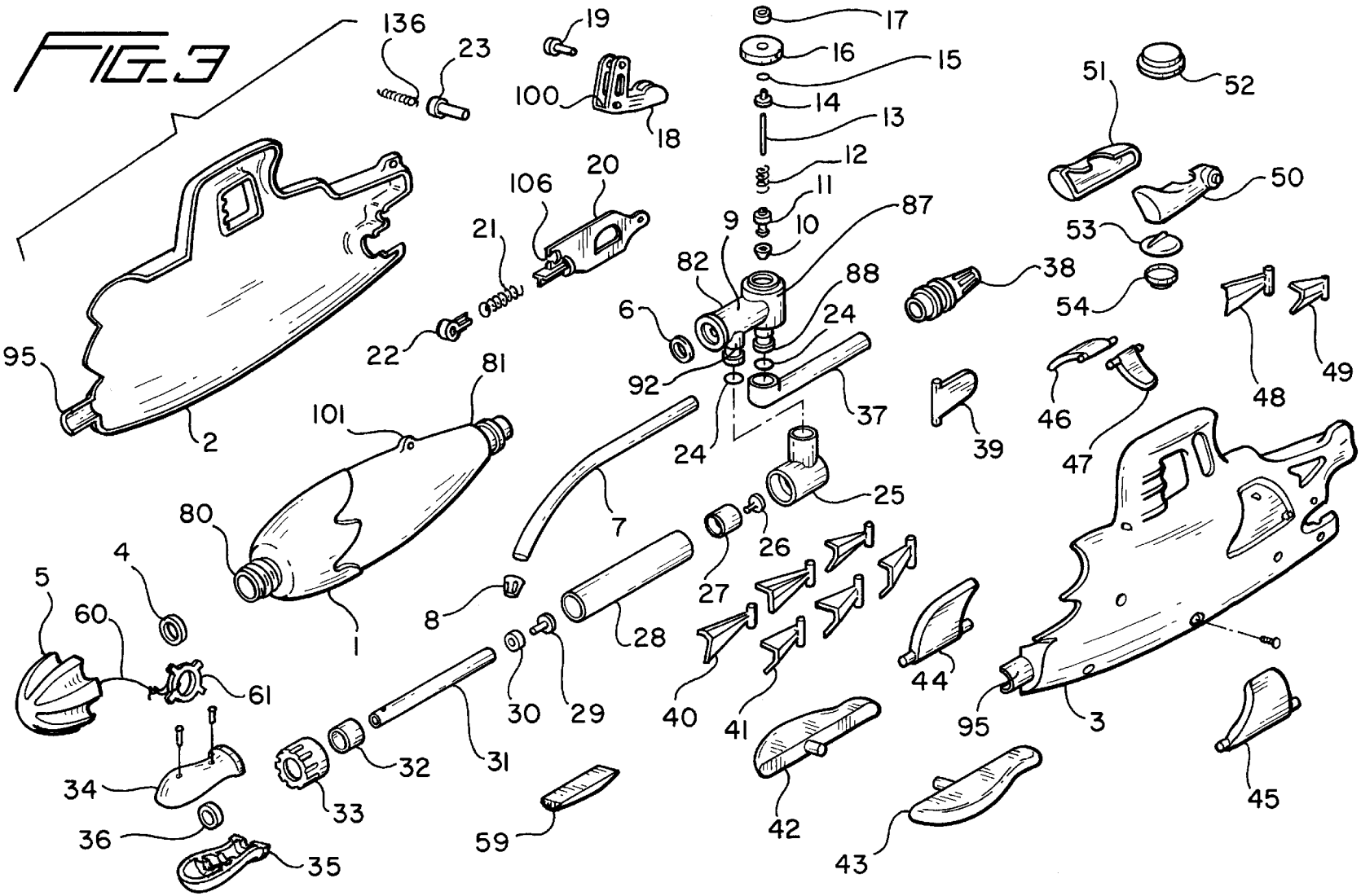
FIG. 3 is an exploded view of the water toy of the preferred embodiment of the invention.
Figure 4:
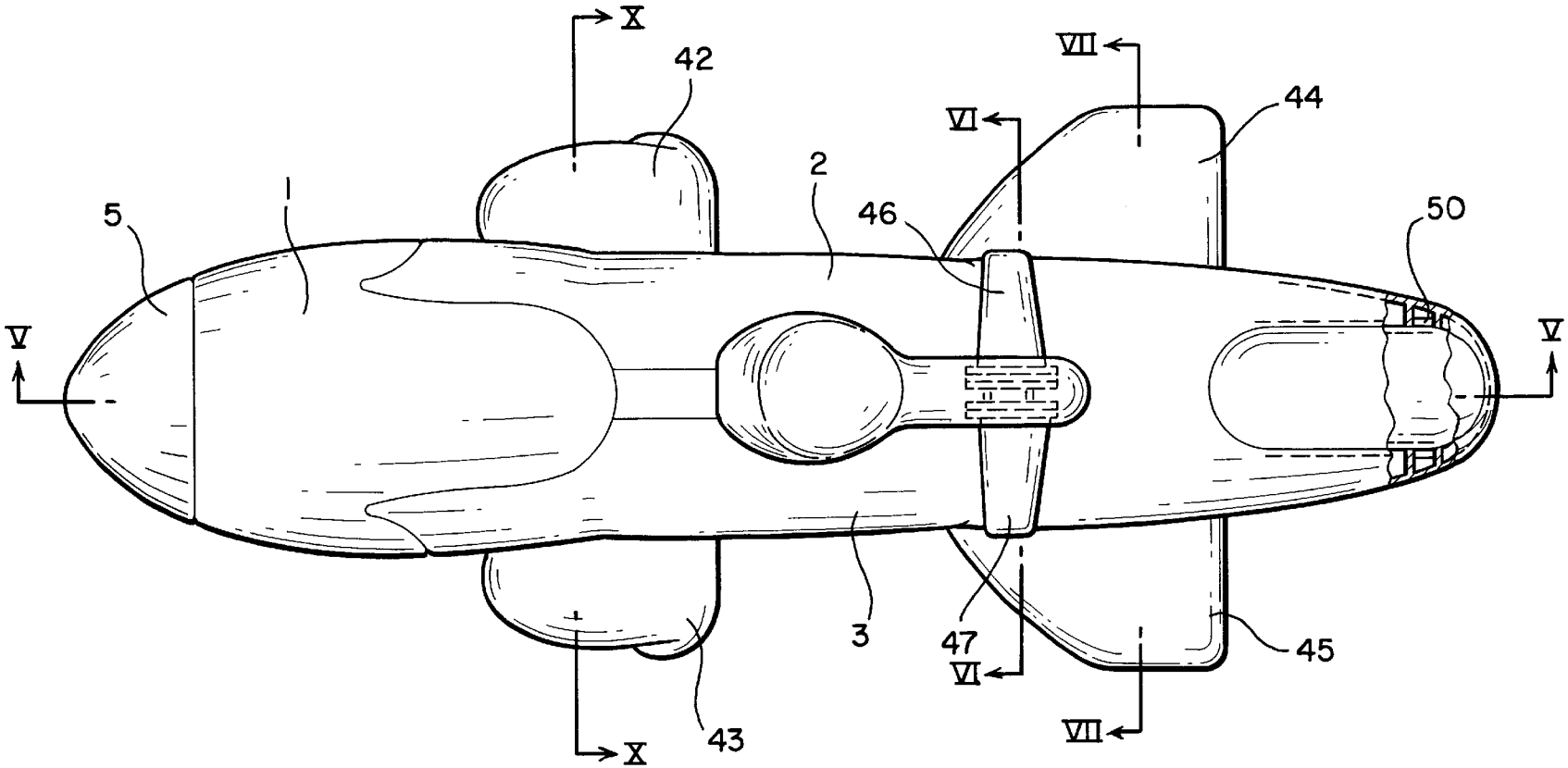
FIG. 4 is a top view of the water toy of the preferred embodiment.

FIGS. 1 and 2 illustrate the manner in which a water gun is combined with a self-propelled toy submarine according to a preferred embodiment of the invention. The combination water gun and submarine of the preferred embodiment has two functional modes, which are manifested in different orientations of the toy. In the first orientation or mode, the toy may be used as a water gun for traditional water gun play, while in a second orientation or mode, the toy may be used as a self-propelled toy water craft that resembles a submarine. As illustrated in FIG. 1, the shape of the toy is such that, in the first orientation or mode, the toy resembles a stylized firearm, including a barrel from which extends a trigger situated midway along the longitudinal length of the barrel. However, as illustrated in FIG. 2, when the toy is turned upside-down relative to the orientation illustrated in FIG. 1, i.e., in the second orientation or mode, the shape of the toy provides a relatively realistic representation of a submarine, with the portion of the housing accommodating the trigger being shaped to resemble a conning tower of a submarine. To achieve this effect, those skilled in the art will note that the main body of the toy which forms the barrel of the firearm and also the hull of the submarine has a relatively more curvaceous shape than the conventional water gun, including a relatively narrow section adjacent the nozzle and opposite the trigger. The appearance of the toy in the submarine mode is greatly enhanced by various appurtenances or accessories described below.

It will be appreciated by those skilled in the art that the "mode" of the toy may also be changed, in the manner of a "transformer" toy, by folding or unfolding parts of the toy, although the illustrated embodiment in which the mode is changed simply by turning the toy-over, with minimal manipulation of folding parts, represents an especially attractive implementation.

Features of the preferred water toy illustrated in FIGS. 1 and 2 include an air/water reservoir 101 extending from a first end of the toy and including a cap 102 arranged to be removed by a user in order to permit the reservoir to be filled with water. A pump handle 104 also extends from the front of the water toy at a position corresponding to a torpedo tube of a submarine. The main body 105 of the water toy supports a trigger 106 positioned within a trigger guard 107 extending from the main body and arranged to resemble a conning tower when in the submarine mode. At a second end of the toy is a nozzle 108, which is positioned at the front of the toy in the water gun mode and at the rear of the toy in the submarine mode, and through which water is expelled in a stream for "shooting" in the water gun mode and for propelling the toy in the submarine mode.

The position of the air/water reservoir at the first end of the toy, i.e., at the front end in the submarine mode, causes the front end of the toy to be heavier than the rear end when the reservoir is filled with water, the weight of the front end gradually diminishing as the reservoir is emptied due to expulsion of water. This may utilized to achieve a "diving" effect in which the submarine toy initially dives below the surface of the water and then returns to the surface as the reservoir empties. The diving effect may also be assisted by ballast which, when removed, permits the toy to be propelled across the surface of the water rather than diving.

Appurtenances or accessories added to enhance the appearance of the water gun or submarine and illustrated in FIGS. 1 and 2 include fins 109, 110, and 111. Fin 109 extends laterally from a mid-portion of the main body and may be pivotal about a horizontal axis to maintain the orientation of the toy when in the submarine mode, and possibly to assist in causing the toy to dive as it is propelled across a body of water, while fins 110 and 111 are respectively situated in a mid-portion of the main body 105 towards the nozzle end and at a side of the trigger guard/conning tower 107, and are arranged to be pivotal from a vertical position in the water gun mode to a horizontal position in the submarine mode, in which the fins may serve as stabilizers or control surfaces. In addition, louvers 112 are arranged to be pivotal from a flush position in the submarine mode to an extended position in the water gun mode so as to enhance the resemblance of the toy to a firearm and a vertically pivotal member 114 is mounted at a rear of the main body 105 to resemble a rudder when in the submarine mode and possibly to assist in steering of the toy as it is propelled through the water.

Finally, as illustrated in FIGS. 1 and 2, a rear handle 113 may be extended in the water gun mode to provide a forward hand grip, as in a submachine gun, the handle also serving as a switch for a circuit and speaker arranged to provide sound effects such as gun sounds in the water gun mode and/or submarine sounds in the submarine mode.

It will be appreciated that while the preferred toy illustrated in FIGS. 1 and 2 is intended to provide an attractive appearance in both the water gun and submarine modes, the toy of the invention is not to be limited to a particular design, nor is it intended to be limited to representation of a particular type of water gun or water craft. The appearance of the toy in both the water gun and "submarine" modes may be entirely fanciful or arbitrary, or it may resemble in either mode a more realistic gun or water craft. Depending on the design and or the objects which the water toy is intended to represent in the two orientations, the appurtenances may be varied in any desired manner, as may the location of the reservoir and trigger mechanism, so long as the reservoir is accessible for filling and the trigger mechanism is accessible for operation.

Details of a particular water trigger and water expelling mechanism or system will now be described in connection with FIGS. 3–10. Since FIGS. 1 and 2 illustrate overall features of the preferred embodiment and not individual parts, certain elements have been renumbered for convenience. For example, the main body 105 is described as being made up of housing halves 2 and 3, the air/water reservoir 101 is described as a container 1, and so forth. In addition, it will be appreciated that the illustrated mechanisms, although described in detail, represents one of a number of potential ways to implement the invention, and that the trigger mechanism and water expelling mechanisms may be varied in numerous ways by the skilled artisan, and that in its broadest form the invention is not intended to be limited to a particular mechanism or system. In addition, while the illustrated embodiment includes a sound effects arrangement, it will be appreciated by the skilled artisan that various other electronic arrangements may be included, including lighting arrangements, remotely controlled motorized appurtenances, or the like.

As indicated above, in embodiment illustrated in detail in FIGS. 3–10, air/water reservoir 101 is in the form of a container 1, a front portion of which protrudes from the main housing formed by housing halves 2 and 3. The front portion ofthe water reservoir includes design elements arranged to be consistent with design elements of the casing halves, which may correspond by way of example to those illustrated in FIGS. 1 and 2. Cap 102 is illustrated in FIGS. 3–10 as being in the form of a screw-on closure member 5, the design of the exterior of which is also consistent with the design of the casing halves 2,3 and container 1, and which may include an appropriate seal 4 surrounding externally threaded neck 80 of the container 1 to prevent leakage. Optionally, the screw-on closure member may be attached to a tether 60 extending from any appropriate element 61 situated within the container 1 and having a dimension larger that the largest dimension of the opening in neck 80 to prevent the closure member 5 from being misplaced as the container is being filled.

Figure 5:
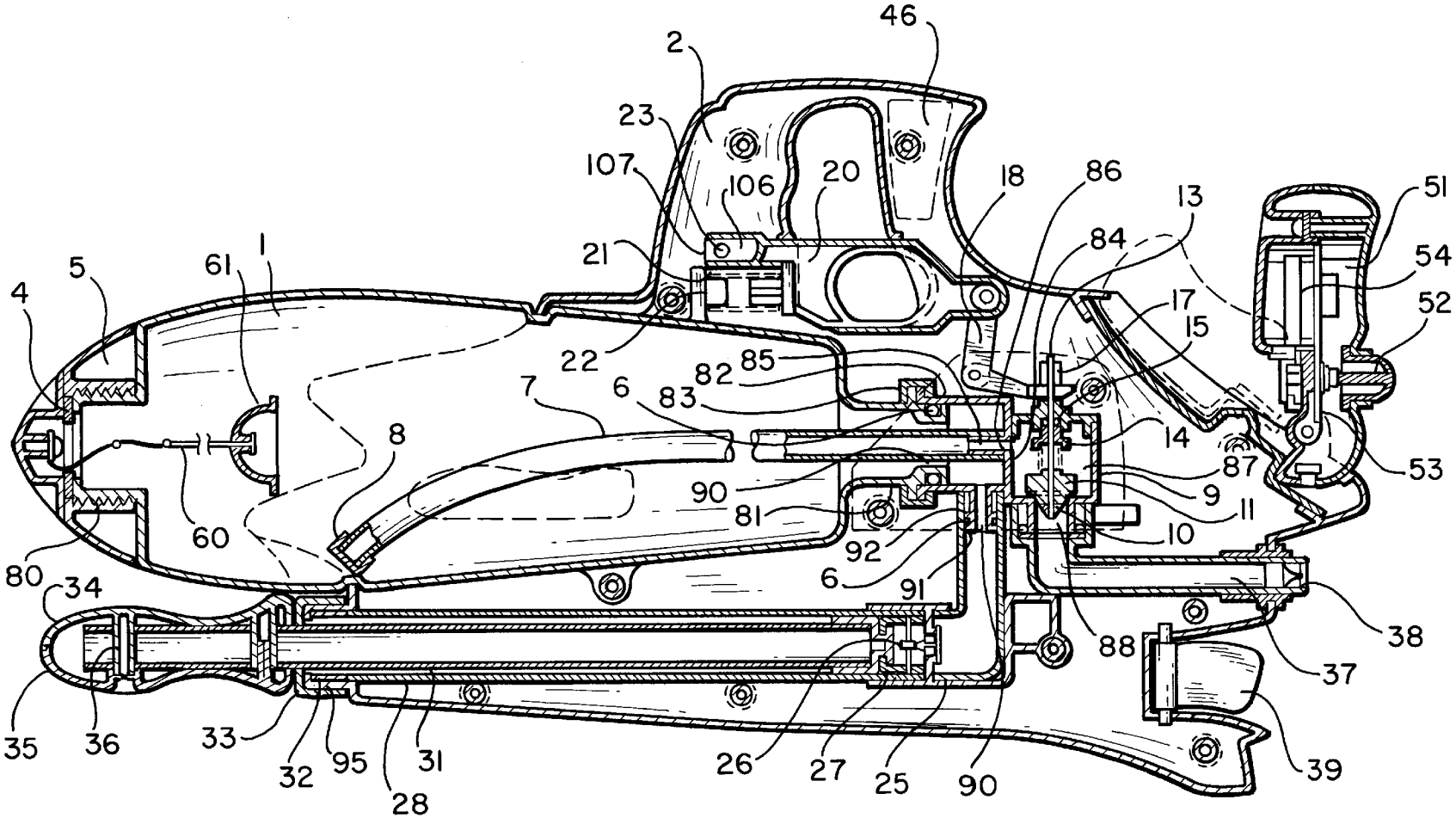
FIG. 5 is a cross-sectional side view taken along line V—V in FIG. 4.
Figure 6:
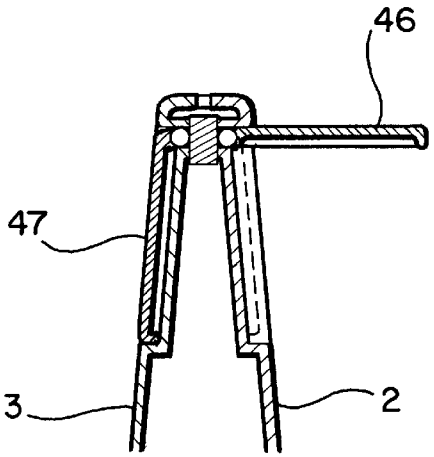
FIG. 6 is a cross-sectional rear end view taken along line VI—VI in FIG. 4.
Figure 7:
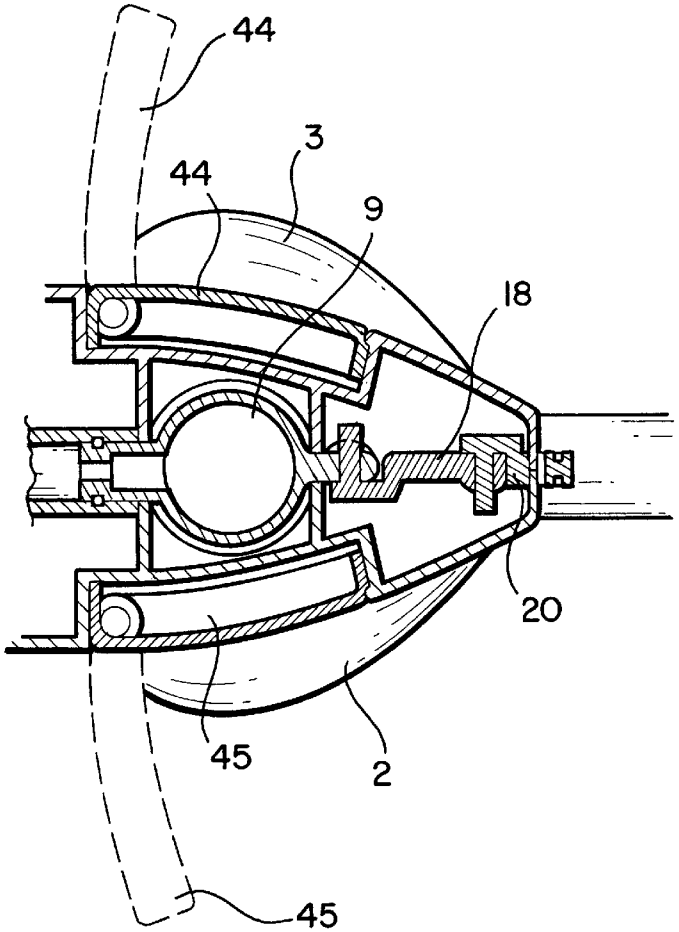
FIG. 7 is a cross-sectional rear end view taken along line VII—VII in FIG. 4.
Figure 8:
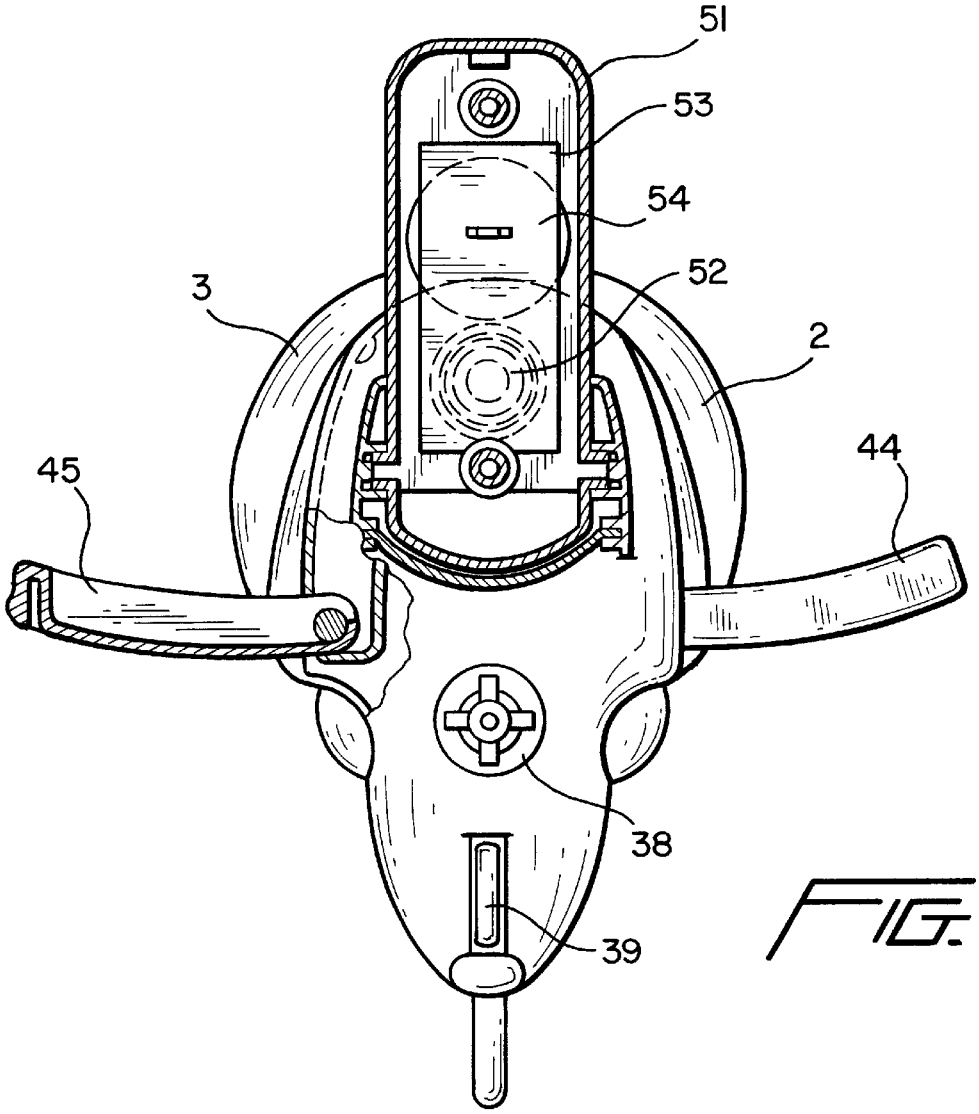
FIG. 8 is an end view of the water toy of the preferred embodiment.
Figure 9:
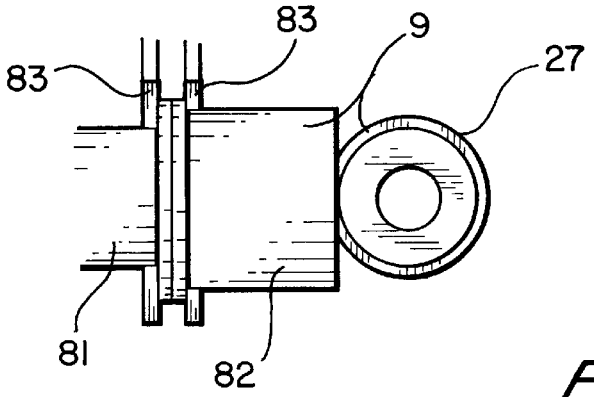
FIG. 9 is a plan view of the main valve of the preferred embodiment.
Figure 10:
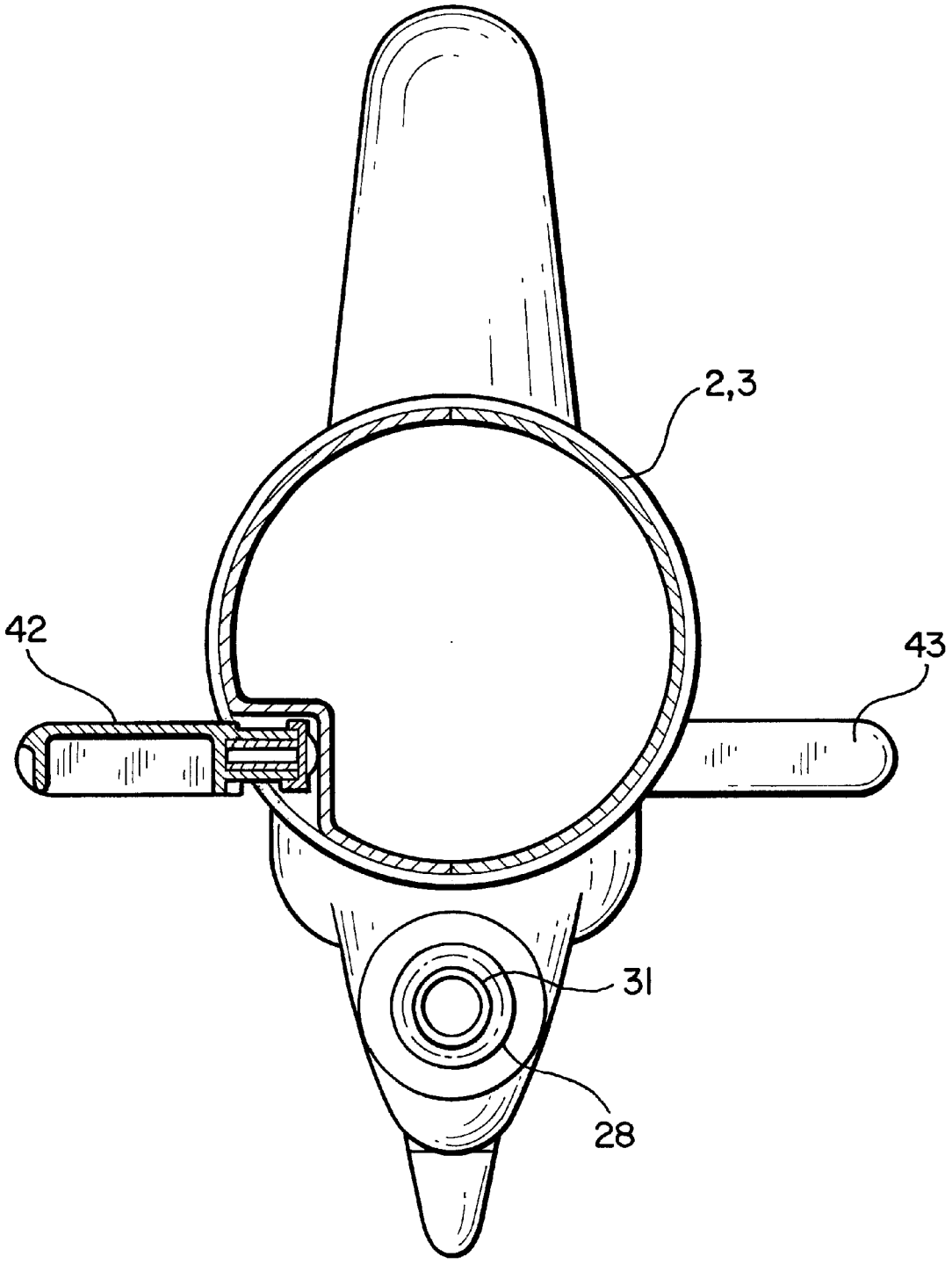
FIG. 10 is a cross-sectional end view taken along line X—X in FIG. 4.

At the opposite end of container 1 is an outlet neck 81 to which is fitted a valve body 9, shown in a plan view in FIG. 9, by an appropriate seal such as o-ring 6. As best shown in FIG. 5, neck 81 is open at its distal end and fits within a corresponding opening in a cylindrical rear section 82 of the valve body 9. An appropriate retaining member 83 may be included to secure the valve body to the container upon fitting the valve body over the neck and o-ring. The interiors of the neck 81 and rear section 82 are thus in communication and form a single chamber separated from the remainder of the valve body by a retaining wall 84 from which extends a cylindrical neck 85 having a passage 86 extending therethrough, and over which is fitted a flexible tube 7 that extends from the retaining wall 84 to a center portion of the container. Tube 7 is fitted at its end with a strainer 8 that prevents entry of materials that might clog the valve or outlet nozzle of the water toy, and which also has the effect of causing the tube to fall or sink towards whichever wall of the container is the lowest wall depending on the orientation of the water gun so that the end of the tube remains submerged in water until the container is essentially empty of water. The only way for water to exit the container is through hose 7 and passage 86 which opens into valve body section 87.

At one side of valve body section 87 is another opening 88 which forms the sole exit for water from the chamber formed by section 87, and which is closed by a seal 10 attached to a bushing 11. Bushing 11 and seal 10 in turn are fitted over a shaft 13 connected to a spring seat 14 and to a bushing 17 to form the valve mechanism that controls whether water is permitted to exit the chamber through elbow outlet 37 and nozzle 38. The valve mechanism also includes appropriate seals such as o-rings 15 which surround spring seat 14 to prevent water from leaking through the cover 16 of the valve body through which the shaft 13 extends. A spring 12 is provided to press bushing 11 and seal 10 into a position in which the opening 88 is sealed to prevent water from leaving section 87 until the bushing and seal are lifted by means of shaft 13 and a trigger mechanism described below.

Water escapes from the valve mechanism and is expelled forcefully through nozzle 38 because it has been pressured by a pump mechanism which injects air into the reservoir formed by the container 1 so as to apply pressure to the water and cause it to flow through tube 7 and fill the valve section 87. Air enters the container 1 through an opening 90 in section 82 of the valve body, which is in communication with neck 81 of the container 1. Opening 90 communicates with a passage 91 in neck 92, over which is fitted the end of elbow fitting 25 and an appropriate seal such as o-ring 6. Elbow fitting 25 is fitted to a valve body 27 containing an umbrella valve 26 arranged to permit passage of air in the direction of the container through an opening 93 in wall 94 of the valve body 27, but to prevent passage of air or water in the opposite direction. At the inlet side of the valve body 27 is fitted a cylinder 28 through which extends a pump shaft or piston 31 having at an end a seal retainer 29 and a seal 30 for forming an air tight seal with the interior wall of the cylinder while permitting movement of the piston longitudinally within the cylinder to form a pump for forcing air into the container 1 in order to apply pressure to water within the container 1. Pump shaft 31 extends through a cylinder end cap 32 and collar 33 of appropriate design for securing the cylinder to an extension 95 formed by portions of the main housing halves 2 and 3, and in addition is secured to a pump handle made up of halves 96 and 97 using an appropriate fitting 98. Those skilled in the art will appreciate that cylinder 28 of the pump mechanism is arranged to draw air into the pump and to force the air through umbrella valve 26 in conventional fashion, and that details of the pump may be varied as desired according to the principles of air pump design.

The trigger mechanism, includes an L-shaped lifter 18 connected to the bushing 17 and shaft 13 to as to lift the shaft and permit water to exit section 17 through outlet 37 and nozzle 38. Opening 100 of lifter 18 is pivotally connected to a pivot 101 on the container 1 by a fastener(not shown) and to an end of the trigger 20 by a pin 19 such that when trigger 20 is moved in a horizontal direction, lifter 18 rotates about pivot 101 to cause the second end of the lifter to move vertically and thereby raise or lower shaft 13. A fitting 22 supports and guides the end of the trigger so that it is constrained to move horizontally, and to support a coil spring 21 which biases the trigger in a forward direction of the toy when the toy is in the water gun mode, so as to close the opening and prevent ejection of water. Opening 104 in the trigger is arranged to coincide with an opening 105 in the housing so that the user's finger can be extended through the opening and operate the trigger.

In order to permit operation as a water craft even when the user's finger is not on the trigger, a trigger latching member 23 is arranged to slide in the housing such that when the trigger is pulled back beyond a normal firing position and it is desired to operate the toy in submarine mode, a coil spring 136 biases the latching member towards the trigger and causes an end of the latching member to enter an opening or notch 106 in an extension 107 of the trigger member and thereby prevent the trigger from returning under the action of bias spring 21. As a result, the valve is maintained in an open position and water is continually ejected from nozzle 38 to propel the water craft even after the trigger has been released. The trigger latch can be caused to disengage from the trigger member by pulling on latch member 23 to release trigger member 106, for example by means of an appropriate button, and remains disengaged so long as the trigger is not pulled back far enough to cause the latching member 123 to enter opening 106.

It will of course be appreciated by those skilled in the art that both the trigger mechanism and the trigger latch may be varied, for example by enabling the trigger latch to positively set by the user upon, for example, moving one of the appurtenances described below into the appropriate submarine or water gun positions, by arranging the latch to be released by gravity when the toy is turned-over, or by varying the manner in which the trigger actuates the valve, and that all variations and modifications are intended to be included within the scope of the invention so long as the trigger mechanism is capable of initiating expulsion of water from the toy in order to operate the toy as a water gun and as a self-propelled water craft.

The appurtenances or accessories for the illustrated toy include stabilizing fins 44,45 and 46,47 (respective elements 110 and 111 illustrated in FIGS. 1 and 2) pivotally attached to the main housing so that they can be folded or pivoted to a horizontal position in the submarine mode, and folded or pivoted to be flush with the main housing in the water gun mode. In addition the toy includes extensions 42,43 (elements 109 shown in FIGS. 1 and 2), rudder member 39 (element 114 shown in FIG. 1), and members 40,41 and 48,49 (elements 113 shown in FIGS. 1 and 2) which may be pivoted flush with the housing when the toy is in the submarine mode, or to suggest the exhaust louvers of a firearm, outwardly from the housing when the toy is in the water gun mode.

The final appurtenance or accessory of the illustrated embodiment of the invention is a pivotal handle (element 113 in FIGS. 1 and 2) made up of halves 50,51, which may be pivoted downwardly from the main body in the water gun mode to suggest the auxiliary handle or cocking mechanism of an automatic firearm. A sound effects system in the form of a speaker 54 and a printed circuit board 53 containing circuitry, such as an integrated circuit, for generating sound effects, is positioned within the pivotal handle and a button 52 extends from the handle to activate the sound effects circuitry. A further button may be included to indicate whether the handle is an up or down position to indicate the mode that the toy is in. The button 52 may be arranged to be pushed in either or both of the submarine and water gun modes, and the sound effects circuitry programmed to make sounds appropriate to the current mode, such as gunfire or submarine sounds, using techniques that are well-known in the toy art. The specific circuitry used to generate the desired sounds forms no part of the present invention and can easily be implemented by those skilled in the art.

Finally, a ballast member 59 may be included, as necessary, to cause the toy to have a desired buoyancy, either for the purpose of floating properly or to assist in submerging the toy in order to mimic the behavior of a submarine. As indicated above, the position of the container 1 is such that the toy can be arranged to be dive when the container is full, and to return to the surface as the container is emptied due to the expulsion of water released by movement and locking of the trigger. In the illustrated embodiment, the ballast which may for example be a metal weight, is positioned within the housing formed by housing halves 2 and 3.

Although various preferred embodiments of the invention have been described with sufficient particularity to enable a person skilled in the art to make and use the invention without undue experimentation, it will be appreciated that numerous other variations and modifications of the illustrated embodiments, in addition to those already noted above, may be made by those skilled in the art. Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. A combination water gun and toy vehicle, comprising:

a housing arranged to resemble a water gun when in a first position and to resemble a toy vehicle when in a second position;

an outlet nozzle through which water is expelled from said housing; and a trigger arranged to cause said water to be expelled from said housing, and an air/water reservoir in fluid communication with said nozzle through a valve, a hand pump for injecting air into said air/water reservoir, and a trigger mechanism for operating said valve in response to movement of the trigger, wherein said nozzle is situated so as be underwater when said toy is in said second position and is caused to float or be submerged in a body of water, wherein continuous expulsion of said water in said second position propels the toy through the water, and wherein, following opening of said valve by said trigger, said trigger mechanism is arranged to be prevented from closing said valve when said housing is in said second position so as to maintain said continuous expulsion of water.

2. A combination water gun and toy vehicle as claimed in claim 1, wherein said toy vehicle is a submarine.

3. A combination water gun and toy vehicle as claimed in claim 2, wherein a water reservoir is arranged such that, when the reservoir is full and the housing is in said second position, the housing dives below a surface of a body of water in which it is placed, and, as the reservoir is emptied due to the expulsion of water, the housing returns to the surface.

4. A combination water gun and toy vehicle as claimed in claim 1, wherein said pump mechanism comprises a cylinder and a one-way valve in fluid communication with said air/water reservoir, said cylinder housing a piston from which extends a shaft and a handle arranged to extend from said housing so as to be grasped by a user, enabling the user to operate the pump and inject air so as to apply pressure to water in said reservoir.

5. A combination water gun and toy vehicle as claimed in claim 1, further comprising a pump mechanism for injecting air so as to apply pressure to water in said housing.

6. A combination water gun and toy vehicle as claimed in claim 5, wherein said pump mechanism is a manual pump mechanism including a piston operated by a handle extending from said housing.

7. A combination water gun and toy vehicle, comprising:

a housing arranged to resemble a water gun when in a first position and to resemble a toy vehicle when in a second position;

an outlet nozzle through which water is expelled from said housing; and a trigger arranged to cause said water to be expelled from said housing, wherein said nozzle is situated so as be underwater when said housing is in said second position and is caused to float or be submerged in a body of water, wherein continuous expulsion of said water in said second position propels the housing through the water, and further comprising appurtenances including members pivotally connected to the housing and arranged to resemble stabilizing or control fins of a submarine when pivoted away from the housing.

8. A combination water gun and toy vehicle, comprising:

a housing arranged to resemble a water gun when in a first position and to resemble a toy vehicle when in a second position;

an outlet nozzle through which water is expelled from said housing; and a trigger arranged to cause said water to be expelled from said housing, wherein said nozzle is situated so as be underwater when said housing is in said second position and is caused to float or be submerged in a body of water, wherein continuous expulsion of said water in said second position propels the housing through the water, and further comprising a rudder member pivotally attached to the housing and arranged to resemble a rudder of a submarine when said housing is in said second position.

9. A combination water gun and toy vehicle, comprising:

a housing arranged to resemble a water gun when in a first position and to resemble a toy vehicle when in a second position;

an outlet nozzle through which water is expelled from said housing; and a trigger arranged to cause said water to be expelled from said housing, wherein said nozzle is situated so as be underwater when said housing is in said second position and is caused to float or be submerged in a body of water, wherein continuous expulsion of said water in said second position propels the housing through the water, and further comprising louvers pivotally connected to the housing and arranged to resemble louvers of a gun when pivoted away from the housing.

10. A combination water gun and toy vehicle, comprising:

a housing arranged to resemble a water gun when in a first position and to resemble a toy vehicle when in a second position;

an outlet nozzle through which water is expelled from said housing; and a trigger arranged to cause said water to be expelled from said housing, wherein said nozzle is situated so as to be underwater when said housing is in said second position and is caused to float or be submerged in a body of water, wherein continuous expulsion of said water in said second position propels the housing through the water, and further comprising a circuit board and a speaker arranged to produce sound effects, and wherein said sound effects are activated by a button situated in an appurtenance pivotally connected to the housing, and wherein said circuit board and speaker are situated in said appurtenance.

11. A toy water craft, comprising:

a housing;

a mechanical pump operated by a handle extending from the housing;

an air/water reservoir in fluid communication with the mechanical pump;

an arrangement for expelling water from the reservoir through a nozzle at one end of the housing in response to air pressure applied by the mechanical pump;

a trigger movable from a closed position in which water is prevented from leaving said reservoir to an open position in which the trigger causes said water to be expelled from the reservoir when moved by a user; and a trigger latch arranged to latch said trigger in said open position so as to cause water to be continuously expelled from the reservoir through a nozzle to outside the housing and thereby propel the water craft.

12. A toy water craft as claimed in claim 11, wherein said toy water craft is a toy submarine.

13. A toy water craft as claimed in claim 12, wherein said air/water reservoir is arranged such that, when the reservoir is full, the submarine dives below a surface of a body of water in which it is placed, and, as the reservoir is emptied due to the expulsion of water, the submarine returns to the surface.

14. A toy water craft as claimed in claim 11, further comprising appurtenances including members pivotally connected to the housing and arranged to resemble stabilizing fins of a submarine when pivoted away from the housing.

15. A toy water craft as claimed in claim 11, further comprising a rudder member pivotally attached to the housing and arranged to resemble a rudder of a submarine.

16. A toy water craft as claimed in claim 11, further comprising a circuit board and a speaker arranged to produce sound effects.

17. A toy water craft as claimed in claim 16, wherein said sound effects are activated by a button situated in an appurtenance pivotally connected to the housing, and wherein said circuit board and speaker are situated in said appurtenance.

18. A toy water craft as claimed in claim 11, wherein when said toy water craft is turned upside-down, it resembles a water gun, said nozzle serving as a nozzle of the water gun, and said latch remaining in an unlatched position.

19. A toy water craft as claimed in claim 18, wherein said latch is a movable member arranged to bear against an extension of said trigger and to enter an opening in said extension when the trigger is pulled sufficiently far to enter the opening, and wherein said movable member is arranged to be pulled out of the opening to permit movement of the trigger.

20. An air pressure operated water gun, comprising a housing;

a mechanism for expelling water from the housing when a trigger is pulled;

a mechanical pump operated by a handle extending from the housing;

an air/water reservoir in fluid communication with the mechanical pump; and a trigger latch arranged to latch said trigger in an open position so as to cause water to be continuously expelled from the reservoir through a nozzle to outside the housing and thereby propel the housing, wherein said water expelling mechanism is arranged to expel water from the reservoir through the nozzle at one end of the housing in response to air pressure applied by the mechanical pump, and wherein said trigger is movable from a closed position in which water is prevented from leaving said reservoir to said open position in which the trigger causes said water to be expelled from the reservoir when moved by a user.

21. A water gun as claimed in claim 20, wherein said pump mechanism is a manual pump mechanism including a piston operated by a handle extending from said housing, a cylinder containing said piston, and connecting elements for connecting said cylinder with said valve body, said connecting elements including a second valve for permitting passage of air in a direction of entering a reservoir and for preventing air and water from escaping the reservoir.

22. A water gun, comprising:

a housing;

a mechanism for expelling water from the housing when a trigger is pulled; and louvers pivotally connected to the housing and arranged to resemble louvers of a gun when pivoted away from the housing, wherein said water gun is configured to resemble a firearm when in a first orientation, and to resemble a water craft when in a second orientation.

23. A water gun, comprising:

a housing;

a mechanism for expelling water from the housing when a trigger is pulled; and a circuit board and a speaker arranged to produce sound effects, wherein said water gun is configured to resemble a firearm when in a first orientation, and to resemble a water craft when in a second orientation, and wherein said sound effects are activated by a button situated in an appurtenance pivotally connected to the housing and arranged to resemble an auxiliary handle of a firearm, and wherein said circuit board and speaker are situated in said appurtenance.

24. A water gun, comprising:

a housing;

a mechanism for expelling water from the housing when a trigger is pulled; and a latch for latching said trigger in an open position in which water is expelled from said housing, wherein said water gun is configured to resemble a firearm when in a first orientation, and to resemble a water craft when in a second orientation.

25. A water gun as claimed in claim 24, wherein said latch is a movable member arranged to bear against an extension of said trigger and to enter an opening in said extension when the trigger is pulled sufficiently far to enter the opening, and wherein said movable member is arranged to be pulled out of the opening to permit movement of the trigger.

* * * * *